United States Patent [19]

Schneider

[11] Patent Number: 4,809,847

[45] Date of Patent: Mar. 7, 1989

[54] SHIPPING AND DISPLAY CONTAINER FOR PLURAL STACKED BOXES

[75] Inventor: Wesley C. Schneider, Chicago, Ill.

[73] Assignee: Tootsie Roll Industries, Incorporated, Chicago, Ill.

[21] Appl. No.: 127,608

[22] Filed: Nov. 30, 1987

Related U.S. Application Data

[63] Continuation of Ser. No. 854,107, Apr. 21, 1986, abandoned.

[51] Int. Cl.[4] ..... B65D 25/64

[52] U.S. Cl. ..... 206/45.31; 206/44.12; 206/45.12; 206/45.29; 211/135; 211/188; 229/40; 229/87 R; 312/117; 312/259

[58] Field of Search ..... 211/135, 186, 188, 189, 211/194; 312/117, 118, 257 R, 258, 259, 114; 206/44 R, 44.12, 45.11, 45.12, 45.21, 45.29, 45.31, 497, 499, 503, 577, 45.14; 229/87 R, 40, 164

[56] References Cited

U.S. PATENT DOCUMENTS 2,914,871 12/1959 Smith et al. ..... 206/45.12

*Primary Examiner*—Stephen Marcus
*Assistant Examiner*—Bryon Gehman
*Attorney, Agent, or Firm*—Wolf, Greenfield & Sacks

[57] ABSTRACT

A shipping and display container for retail sales of small items such as candy includes a plurality of vertically stacked boxes, each with a front opening for removal of merchandise and a vertical divider for mechanical strength. The boxes can be glued together. A display tray is glued to the top of the stacked boxes. A decorative wrapper, which is glued around three sides of the stacked boxes and display tray, includes easily removable perforated access panels aligned with the front openings in the boxes. The access panels are left in position during shipment and are removed for display. A base pallet is attached to the bottom of the container for protection thereof and for raising the level of the container to facilitate display.

19 Claims, 2 Drawing Sheets

SHIPPING AND DISPLAY CONTAINER FOR PLURAL STACKED BOXES

This application is a continuation, of application Ser. No. 854,107, filed 04/21/86, now abandoned.

FIELD OF THE INVENTION

This invention relates to an improved shipping and display container for small consumer items and, more particularly, to a container which can be used effectively for both shipment and retail display of a variety of different items.

BACKGROUND OF THE INVENTION

The costs of shipping and displaying small retail products that are normally sold in supermarkets, drugstores and similar retail operations are a significant part of the overall cost of merchandising such products. For that reason, there is a constant need to provide improved means for shipping and displaying such small items as candy and the like. Usually, such items are shipped in paperboard cartons.

In the past, cartons have been designed for both shipping and display purposes. However, these cartons have had a variety of limitations which adversely affect their function for shipping or display, or both. For example, shipping cartons which consist essentially of rectangular paperboard cartons having a selective arrangement of dividers within the container to be reassembled after shipment for display with a sign have been known for some time. Some of these cartons are complicated to manufacture and, therefore, are costly, while others are not sufficiently sturdy to support and contain significant weight during shipment. Others have significant limitations which inhibit use on pallets and limit the ability to properly handle the containers during shipment. When such containers are designed to hold several different products, it has been necessary to assemble the products from different sections of the factory and then transfer them to the container.

Many off-shelf display containers have required difficult or time-consuming assembly procedures. When such assembly procedures are required, the retailer's profit is reduced or the product is not selected for sale by the retailer. To insure use of off-shelf displays by the retailer, the manufacturer has often been required to have a direct sales force to promote and set up such displays.

It is an object of the present invention to provide new and improved shipping and display containers.

It is another object of the present invention to provide a novel shipping and display container having a plurality of sections for display of different merchandise types.

It is a further object of the present invention to provide a novel shipping and display container having a plurality of easily removable front panels for display of and access to the merchandise.

It is a further object of the present invention to provide a novel shipping and display container having a plurality of easily removable front panels for display of merchandise and a top display section which is accessed by removal of a top cover.

It is another object of the present invention to provide a novel shipping and display container which is converted from a shipping container to a display container with a minimum of effort.

It is a further object of the present invention to provide a novel shipping and display container having a plurality of individual boxes held in position by a paperboard wrapper.

It is a further object of the present invention to provide a novel shipping and display container having a combination of features which reduce the cost and effort associated with the shipping, handling and display of small items.

SUMMARY OF THE INVENTION

According to the present invention, these and other objects and advantages are achieved in a shipping and display container comprising a plurality of vertically stacked boxes, each having a front opening for removal of items therefrom and a wrapper for retaining the stacked boxes in fixed relative positions. The wrapper includes easily removable access panels individually aligned with the front opening in each stacked box. The container is shipped and stored with the access panels in position and is used for merchandising display with the panels removed.

The wrapper is preferably cardboard or paperboard wrapped around three sides of the vertically stacked boxes and attached thereto with adhesive. The removable panels in the cardboard or paperboard wrapper are perforated at the edge to facilitate removal. The container can include a top display section and a display card which is stored in the top section during shipment and is mounted vertically for display at the rear of the top section. The container is preferably attached by adhesive to a base pallet for protection thereof during display, for savings through mechanized handling and to raise the level thereof for easy access by customers. Alternatively, the container can be raised for easy access by a cardboard support. The stacked boxes are preferably attached together by adhesive and include one or more internal dividers to improve mechanical strength.

Prior to shipment, a heat shrinkable film can be placed around the container for protection of the merchandise and to prevent inadvertent removal of the access panels. The container is strapped to the base pallet. A number of the containers mounted on individual base pallets fit conveniently on a conventional-sized shipping pallet.

The individual boxes can be filled in separate sections of the factory and assembled into the container of the present invention in a shipping department. The container is easily converted for display at the retail location and is extremely sturdy to withstand abuse during shipment and during display.

BRIEF DESCRIPTION OF THE DRAWINGS

For a better understanding of the present invention together with other and further objects, advantages and capabilities thereof, reference may be had to the accompanying drawings in which.

DETAILED DESCRIPTION OF THE INVENTION

Figure 1:
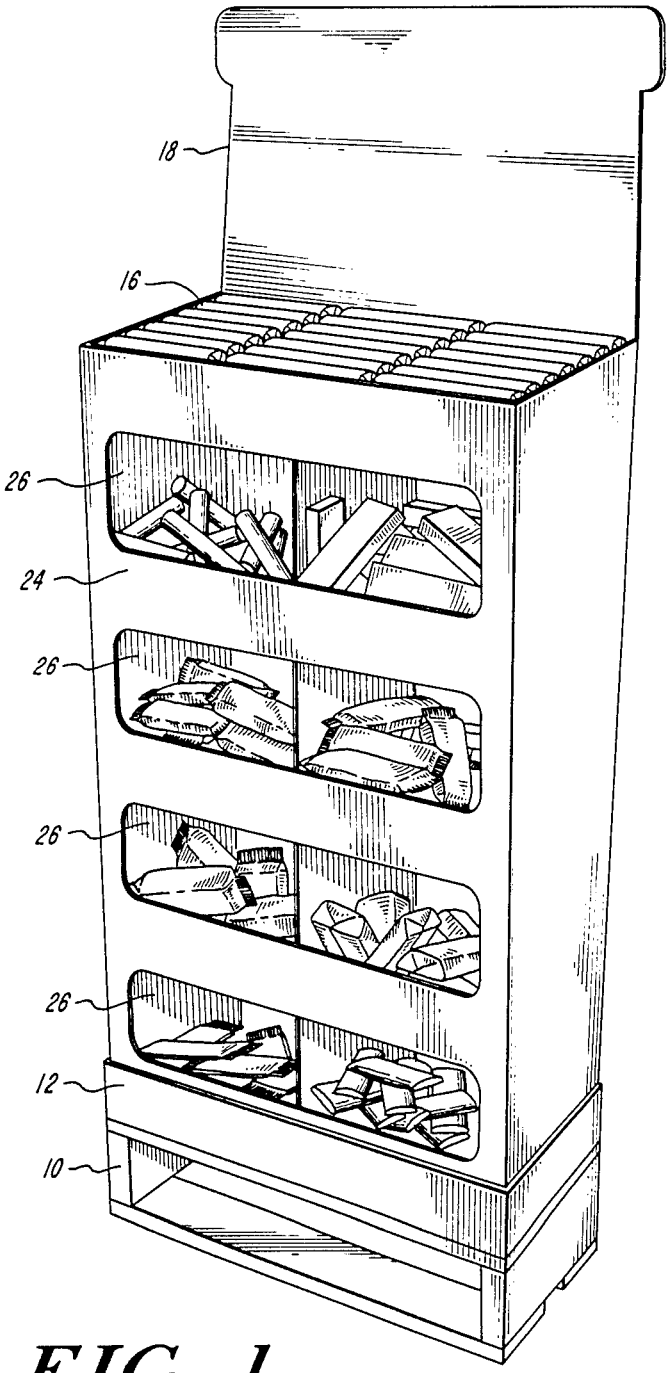
FIG. 1 is a perspective view of a shipping and display container in accordance with the present invention, shown set up for a merchandise display.
Figure 2:
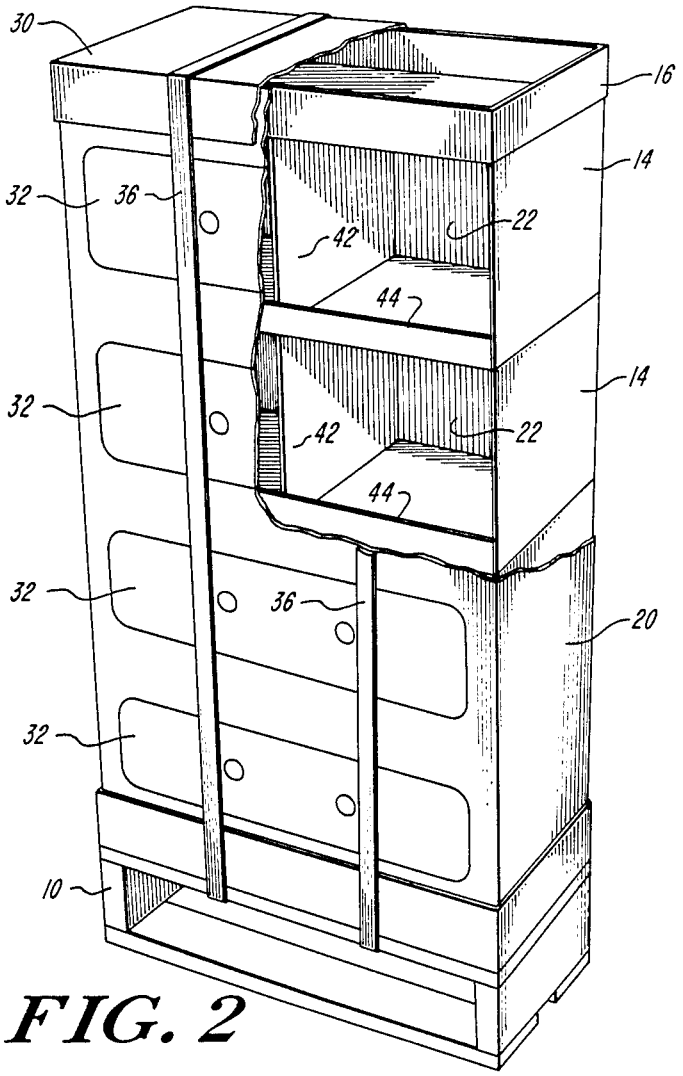
FIG. 2 is a fragmentary perspective view of a shipping and display container in accordance with the present invention, set up for shipping or storage.

The shipping and display container of the present invention is shown set up for display in FIG. 1. FIG. 2 illustrates the container set up for shipping and storage, with a fragmentary view illustrating the internal structure. The container is free-standing and generally rectangular in shape. It consists of a stacked array of a base pallet 10, a bottom tray 12, a plurality of individual boxes 14 (see FIG. 2), a display tray 16, a display panel 18 and a wrapper 20.

Individual boxes 14 are stacked one upon the other with open fronts 22. The boxes 14 are glued together and in turn are glued as a stack in bottom tray 12. The bottom tray 12 is glued to the base pallet 10 which has the same length and width dimensions as the tray 12 and boxes 14. The display tray 16 is glued to the top box 14. The wrapper 20 is a three-sided panel member which closes the open fronts 22 of boxes 14. Vertical front wall 24 of wrapper 20 is provided with a plurality of access openings 26 for viewing and removal of merchandise contained in internal compartments which are defined by the internal structure of the boxes 14. The access openings 26 are closed with panels for shipment and storage, as described hereinafter. Display tray 16 holds additional merchandise with the display panel 18 mounted at the rear thereof for advertising, pricing information and the like. The bottom tray 12 is preferably of heavyweight paperboard with four raised sides for protection of the bottom portion of the container. The lower portion of the wrapper 20 extends into bottom tray 12 and is protected thereby.

The base pallet 10 can be of conventional wood construction and is typically attached to the bottom tray 12 by suitable commercial adhesive used to permanently cement cardboard to wood. The base pallet 10 protects the container against damage during shipment and handling, and acts as a kick stand for protection of the container during display. In addition, the base pallet 10 raises the container level during display to facilitate removal of merchandise by customers. Alternatively, the base pallet 10 can be replaced by a cardboard support such as a false bottom or cardboard brace in the container to raise the level of the lower display section off the floor by several inches.

Referring now to FIG. 2, the shipping and display container of the present invention is shown ready for shipment. The display panel 18 is laid flat on top of the display tray 16. A top cover 30 of heavyweight paperboard is placed over the display tray 16. The top cover 30 is a flat panel of paperboard with four raised sides, which is inverted when covering display tray 16. Access panels 32 cover access openings 26 so as to provide an enclosed container for shipment. A heat shrinkable film is positioned around the container and heated to induce shrinkage. The film maintains the access panels 32 in position and protects the merchandise against moisture. Shipping straps 36 are placed around the unit as shown in FIG. 2 and tightened for shipment.

In a preferred shipping mode, eight of the containers shown in FIG. 2 are placed on a conventional-sized shipping pallet. Two such pallets can then be stacked in a standard-size truck body for maximum shipping efficiency.

The internal construction of the shipping and display container of the present invention is illustrated in the fragmentary portion of FIG. 2. A number of three-sided paperboard boxes 14 are stacked vertically with the open front 22 of each box 14 facing horizontally. The boxes 14 are glued together with an appropriate commercial adhesive, and the paperboard display tray 16 is attached to the top of the unit with adhesive to form a box assembly. The display tray is a flat paperboard panel with four raised sides. Each of the boxes 14 can be provided with one or more vertical dividers 42 for strengthening the weight-bearing potential of the assembly for multiple vertical stacking, for warehousing and shipment and for subdividing the space within the boxes into compartments. Front ribs 44 extend across the bottom of each open front 22 of box 14. The ribs 44 add further strength to the assembly by preventing collapse of the weight-carrying parts of the boxes 14.

Figure 3:
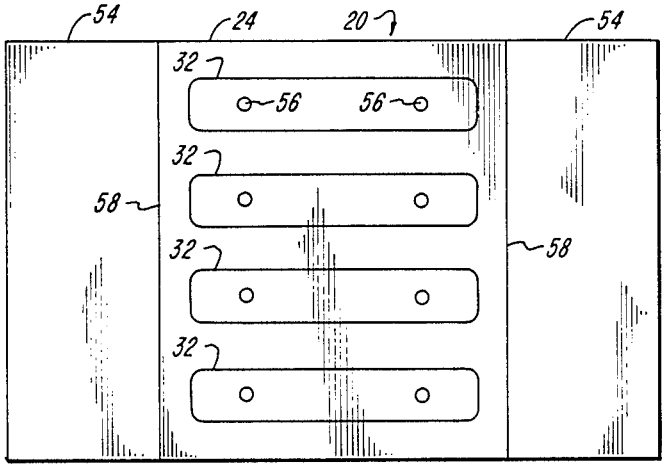
FIG. 3 is an illustration of the wrapper which is positioned around the box assembly of FIG. 2.

After assembly of the boxes 14 and the display tray 16, the wrapper 20 is provided to enclose the unit for shipment and to make a unitary shipping and display container. A preferred embodiment of a wrapper 24 is shown in FIG. 3, in a flat condition prior to installation on the shipping container. The paperboard wrapper 20 includes the front wall 24 which contains the access panels 32, and left and right side portions 54. The access panels 32 are made as parts of the paperboard panel and are initially perforated at the edges by appropriate die cutting to facilitate later tear-out removal. The panels 32 also include perforated tear-out pieces 56 which provide a place to grip for removal of the access panels 32. The side portions 54 are folded back at lines 58 and wrapped around the box assembly shown in FIG. 2, with each access panel 32 aligned with an open front 22 of each box 14. The wrapper 20 is glued in position around the front and sides of the box assembly. The wrapper 20 is typically printed with decorative or advertising material. It will be understood that in another embodiment of the present invention, the wrapper can be a four-sided paperboard unit which slides over the box assembly.

The boxes 14 can be filled with different types of merchandise in separate parts of the factory and brought together in a shipping department for quick assembly by gluing the boxes 14 together into the unit shown in FIG. 2. The wrapper 20 is then placed around the box assembly and glued. The top cover 30, the heat shrinkable film and straps 36 are installed, and the unit is ready for shipment.

The unit shown and described above is convenient for shipping because it has been sized for shipment with other similar units on a conventional shipping pallet. In a preferred embodiment, the shipping and display container is 22 inches wide, 10¼ inches deep and 40 inches high when packed for shipment. In addition, because of the small size of the individual shipping and display containers, they can, if desired, be brought through the front door of a retail store and set up for display without the necessity for elaborate shipping and moving procedures. In one alternative construction of the present invention, the width of the container shown in FIG. 1 is reduced by one half and the dividers 42 are eliminated. This provides a suitable display for smaller spaces and is handled very easily.

When the unit reaches its final destination, the straps 36 are cut. The heat shrinkable film is removed and the access panels 32 are snapped out of the wrapper 20 to provide access to the merchandise. Then top cover 30 is removed and display panel 18 is set in position at the rear of the display tray 16. At this point, the shipping and display container is ready for retail use without the necessity for assembly procedures, knives or other tools for opening and assembling the unit. The convenience and profit of the retailer is enhanced since the container is essentially preassembled and the manufacturer is able to operate without a direct sales force to set up off-shelf displays. The recent use of direct product profitability modeling programs has confirmed the advantages of the shipping and display container of the present invention.

While there has been shown and described what is at present considered the preferred embodiments of the invention, it will be obvious to those skilled in the art that various changes and modifications may be made therein without departing from the scope of the present invention as defined by the appended claims.

What is claimed is:

1. A shipping and display container comprising:

a plurality of vertically stacked boxes, each having a front opening for removal of items of therefrom; and a wrapper for retaining said stacked boxes in fixed relative positions, said wrapper being fixedly attached to said stacked boxes, said wrapper having a plurality of easily removable access panels, one panel aligned with the front opening in each of said stacked boxes, said container being shipped and stored with said access panels in position and being used for display with said panels removed to permit viewing and removal of merchandise from the stacked boxes.

2. A shipping and display container as defined in claim 1 further including a display tray positioned at the top of said stacked boxes and having an open top for display of merchandise.

3. A shipping and display container as defined in claim 2 further including a display card which is carried in said display tray during shipment and storage and is mounted in a vertical position at the rear of said display tray for display of advertising and other information.

4. A shipping and display container as defined in claim 1 further including a top cover for protection of the uppermost of said stacked boxed during shipment and storage.

5. A shipping and display container as define in claim 1 further including a bottom tray for protection of the lowermost of said stacked boxes during shipment.

6. A shipping and display container as defined in claim 1 further including dividers for adding mechanical support to the container and for subdividing individual ones of said stacked boxes.

7. A shipping and display container as defined in claim 1 further including a base pallet attached to the bottom of said container for protection thereof and for raising the level of said container to facilitate display.

8. A shipping and display container as defined in claim 7 further including a bottom tray attached to said pallet for receiving the lowermost of said stacked boxes.

9. A shipping and display container as defined in claim 1 wherein said wrapper includes a front section containing said access panels and left and right side sections attached by adhesive to said stacked boxes to form a single unit.

10. A shipping and display container as defined in claim 9 wherein said wrapper is a single piece of paperboard and said access panels are perforated at the edges to facilitate tear-out removal.

11. A shipping and display container as defined in claim 10 wherein a front section of said wrapper is rectangular in shape and includes a plurality of vertically aligned openings for access to the merchandise in said stacked boxes.

12. A shipping and display container as defined in claim 1 wherein said vertically stacked boxes are attached together with adhesive to improve the mechanical strength of said container.

13. A shipping and display container as defined in claim 1 further including a paperboard rib across the bottom of the front opening in each of said boxes for adding mechanical strength to the container.

14. A shipping and display container comprising:

a plurality of vertically stacked boxes each having a front opening for removal of merchandise therefrom, said boxes including vertical dividers for adding mechanical support to the container and for subdividing said stacked boxes;

a display tray positioned at the top of said stacked boxes and having an open top for display of merchandise;

a top cover for covering the display tray and for retaining merchandise therein during shipment;

a decorative single-piece wrapper for retaining said stacked boxes and said display tray in fixed relative positions, said wrapper being fixedly attached to said stacked boxes, said wrapper having a plurality of easily removable access panels one panel aligned with the front having in each of said stacked boxes, said container being shipped and stored with said access panels in position and being used for display with said panels removed to permit viewing and removal of merchandise from the stacked boxes; and a base pallet attached to the bottom of said container for protection thereof and for raising the level of said container to facilitate display.

15. A shipping and display container as defined in claim 14 wherein said wrapper is a single piece of paperboard and said access panels are perforated at the edges to facilitate tear-out removal.

16. A shipping and display container as defined in claim 15 wherein a front section of said wrapper is rectangular in shape and includes a plurality of vertically aligned openings for access to the merchandise in said stacked boxes.

17. A shipping and display container as defined in claim 14 wherein said vertically stacked boxes are attached together with adhesive to improve the mechanical strength of said container.

18. A shipping and display container comprising:

a plurality of vertically stacked boxes each having a front opening for removal of merchandise therefrom, said boxes including vertical dividers for adding mechanical support to the container and for subdividing said stacked boxes, each of the stacked boxes except the lowermost box being supported primarily by the box below it so that the shipping and display container retains its structural integrity as the merchandise is removed; and decorative single-piece wrapper for retaining said stacked boxes in fixed relative position, said wrapper being fixedly attached to said stacked boxes, said wrapper having a plurality of easily removable access panels one access panel aligned with the front opening in each of said stacked boxes, said container being shipped and stored with said access panels in position and being used for display with said panels removed to permit viewing and removal of merchandise from the stacked boxes.

19. A shipping and display container as defined in claim 18 further including a display tray on top of said stacked boxes for display or merchandise, a top cover for covering the display tray during shipment, and a base pallet attached to the bottom of said container for protection thereof and for raising the level of said container to facilitate display.

* * * * *